US010557318B2

(12) United States Patent
Slavens et al.

(10) Patent No.: US 10,557,318 B2
(45) Date of Patent: Feb. 11, 2020

(54) EARTH-BORING TOOLS HAVING MULTIPLE GAGE PAD LENGTHS AND RELATED METHODS

(71) Applicant: Baker Hughes, Houston, TX (US)

(72) Inventors: Stephen Manson Slavens, Cypress, TX (US); Zachary Borders, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 164 days.

(21) Appl. No.: 15/812,866

(22) Filed: Nov. 14, 2017

(65) Prior Publication Data

US 2019/0145189 A1 May 16, 2019

(51) Int. Cl.

| | |
|---|---|
| ***E21B 17/10*** | (2006.01) |
| ***E21B 10/43*** | (2006.01) |
| ***E21B 10/55*** | (2006.01) |
| ***E21B 10/62*** | (2006.01) |

(52) U.S. Cl.

CPC ..... *E21B 17/1092* (2013.01); *E21B 10/43* (2013.01); *E21B 10/55* (2013.01); *E21B 10/62* (2013.01)

(58) Field of Classification Search

CPC ..... E21B 17/1092; E21B 10/43; E21B 10/62; E21B 10/55

See application file for complete search history.

(56) References Cited

U.S. PATENT DOCUMENTS

| | | | | |
|---|---|---|---|---|
| 5,004,057 | A | 4/1991 | Tibbitts et al. | |
| 6,123,160 | A * | 9/2000 | Tibbitts | E21B 10/26 175/385 |
| 6,260,636 | B1 | 7/2001 | Cooley et al. | |
| 6,349,780 | B1 | 2/2002 | Beuershausen | |
| 6,460,631 | B2 * | 10/2002 | Dykstra | E21B 10/42 175/428 |
| 6,484,825 | B2 | 11/2002 | Watson et al. | |
| 6,684,967 | B2 | 2/2004 | Mensa-Wilmot et al. | |
| 8,100,196 | B2 | 1/2012 | Pastusek et al. | |

(Continued)

OTHER PUBLICATIONS

International Written Opinion for International Application No. PCT/US2018/060252 dated Mar. 13, 2019, 7 pages.

(Continued)

*Primary Examiner* — Michael R Wills, III
(74) *Attorney, Agent, or Firm* — TraskBritt

(57) ABSTRACT

Earth-boring tools include a body, at least one first blade extending outward from the body, and at least one second blade extending outward from the body. The at least one first blade includes an upper surface, a first gage region having a first longitudinal length, and a recess extending at least partially into the at least one first blade from the upper surface. The at least one second blade includes a second gage region having a second, greater longitudinal length. Additional earth-boring tools include first blades having first gage regions of a first longitudinal length and second blades having second gage regions of a second, greater longitudinal length. An upper external surface is tapered radially outward in a longitudinally upward direction relative to a central axis of the earth-boring tool. Methods including forming such first and second blades and removing material from the first blades to form recesses.

20 Claims, 4 Drawing Sheets

(56) References Cited

U.S. PATENT DOCUMENTS

| | | | | |
|---|---|---|---|---|
| 9,279,293 | B2 | 3/2016 | Izbinski | |
| 2007/0205024 | A1 | 9/2007 | Mensa-Wilmot | |
| 2007/0272446 | A1 | 11/2007 | Mensa-Wilmot | |
| 2013/0153306 | A1 | 6/2013 | Burhan et al. | |
| 2014/0311801 | A1 | 10/2014 | Jain et al. | |
| 2016/0032658 | A1 | 2/2016 | Jain | |
| 2016/0097237 | A1* | 4/2016 | Spencer | E21B 17/1092 175/61 |
| 2017/0074047 | A1 | 3/2017 | Jain | |
| 2017/0175454 | A1 | 6/2017 | Ricks et al. | |

OTHER PUBLICATIONS

International Search Report for International Application No. PCT/US2018/060252 dated Mar. 13, 2019, 3 pages.

* cited by examiner

EARTH-BORING TOOLS HAVING MULTIPLE GAGE PAD LENGTHS AND RELATED METHODS

TECHNICAL FIELD

Embodiments of this disclosure relate generally to earth-boring tools and methods of forming earth-boring tools.

BACKGROUND

Oil wells (wellbores) are usually drilled with a drill string. The drill string includes a tubular member having a drilling assembly that includes a single drill bit at its lower end. The drilling assembly typically includes devices and sensors that provide information relating to a variety of parameters relating to the drilling operations, behavior of the drilling assembly, and parameters relating to the formations penetrated by the wellbore. A drill bit and/or reamer of the drilling assembly is rotated by rotating the drill string from the drilling rig and/or by a drilling motor (also referred to as a "mud motor") in the bottom hole assembly ("BHA") to remove formation material to drill the wellbore. A large number of wellbores are drilled along non-vertical, contoured trajectories in what is often referred to as directional drilling. For example, a single wellbore may include one or more vertical sections, deviated sections, and horizontal sections extending through differing types of rock formations.

When a fixed-cutter, or so-called "drag," bit or other earth-boring tool progresses from a soft formation, such as sand, to a hard formation, such as shale, or vice versa, the rate of penetration ("ROP") may change. Excessive ROP fluctuations and/or vibrations (lateral or torsional) may be generated in the drill bit. The ROP is typically controlled by controlling the weight-on-bit ("WOB") and rotational speed (revolutions per minute or "RPM") of the drill bit. WOB is controlled by controlling the hook load at the surface and RPM is controlled by controlling the drill string rotation at the surface and/or by controlling the drilling motor speed in the BHA. Controlling the drill bit vibrations and ROP by such methods requires the drilling system or operator to take actions at the surface. The impact of such surface actions on the drill bit fluctuations is not substantially immediate, due to the length of the drill string between the surface and the BHA. Drill bit aggressiveness contributes to vibration, whirl, and stick-slip for a given WOB and drill bit rotational speed. "Depth of Cut" (DOC) of a fixed-cutter drill bit, generally defined as a distance a bit advances into a formation over a revolution, is a significant contributing factor relating to the drill bit aggressiveness. Controlling DOC can prevent excessive formation material buildup on the bit (e.g., "bit balling,"), limit reactive torque to an acceptable level, enhance steerability and directional control of the bit, provide a smoother and more consistent diameter borehole, avoid premature damage to the cutting elements, and prolong operating life of the drill bit.

Earth-boring tools experience significant impacts and non-axial forces during formation of a wellbore. These impacts and forces may cause the tools to react in unstable and unpredictable ways, such as in a so-called "stick-slip" or "bit whirl" situation.

BRIEF SUMMARY

In some embodiments, the present disclosure includes earth-boring tools including a body, at least one first blade extending outward from the body, and at least one second blade extending outward from the body. The at least one first blade includes an upper surface, a first gage region having a first longitudinal length, and a recess extending at least partially into the at least one first blade from the upper surface. The at least one second blade includes a second gage region having a second longitudinal length that is greater than the first longitudinal length.

In some embodiments, the present disclosure includes earth boring tools including a body including a shank, neck, and crown coupled to each other. The crown includes first blades having first gage regions of a first longitudinal length and second blades having gage regions of a second longitudinal length greater than the first longitudinal length. The second blades extend closer to the neck than the first blades. The crown also includes an upper external surface between the neck and the first and second blades. The upper external surface is tapered radially outward in a longitudinally upward direction relative to a central axis of the earth-boring tool.

In some embodiments, the present disclosure includes methods of forming earth-boring tools. According to such methods, a body is formed to include first blades extending from the body and second blades extending outward from the body. The first blades have first gage pads of a first longitudinal length and the second blades have second gage pads of a second, greater longitudinal length. Material is removed from the first blades through an upper surface of the first blades to form recesses extending at least partially through the first blades.

DETAILED DESCRIPTION

Figure 1:
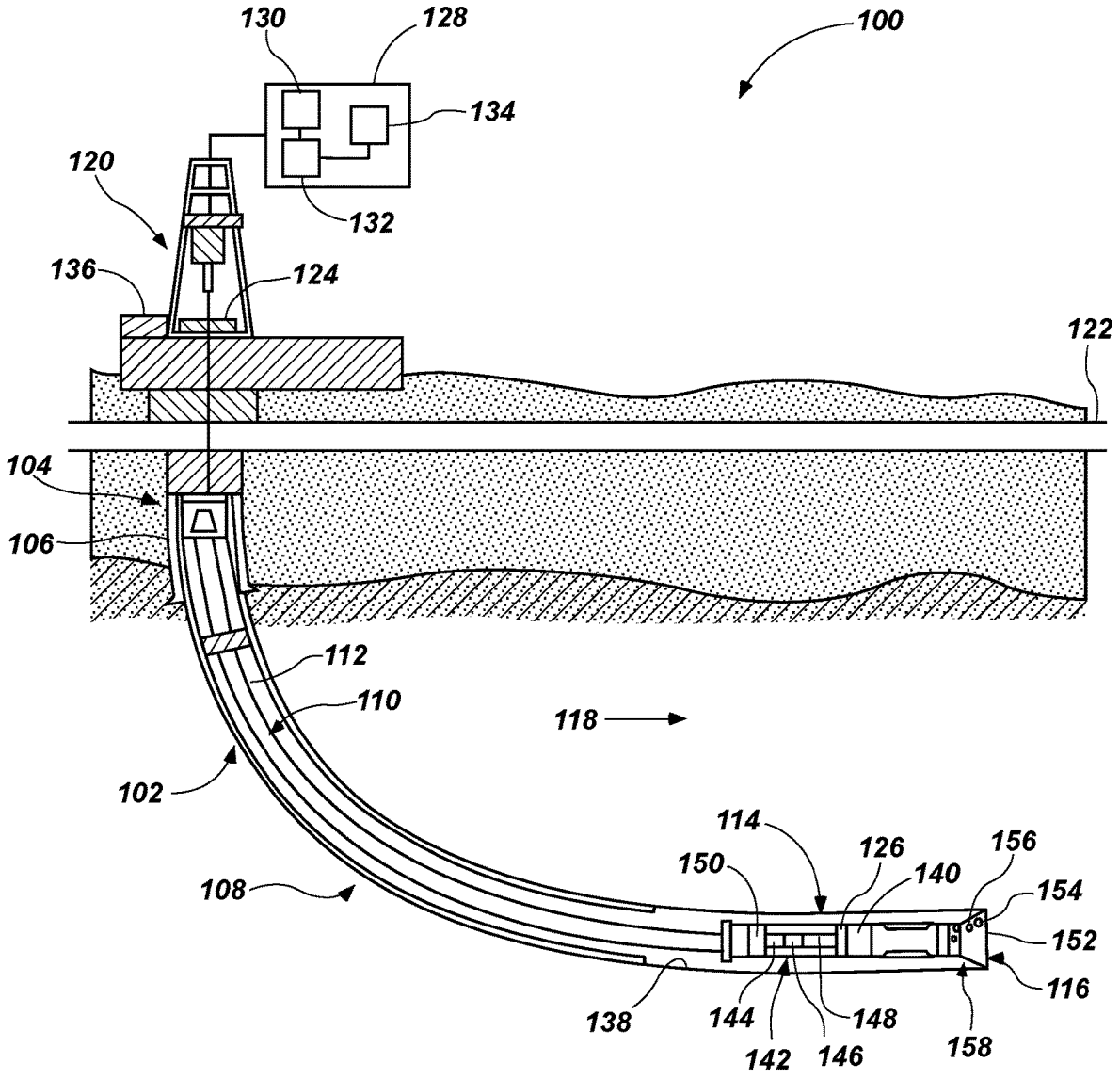
FIG. 1 is a schematic diagram of a wellbore system including a drill string that includes a drill bit according to an embodiment of the present disclosure.

The illustrations presented herein are not actual views of any particular drilling system, drilling tool assembly, or component of such an assembly, but are merely idealized representations, which are employed to describe the present invention.

As used herein, the term "earth-boring tool" means and includes earth-boring tools for forming, enlarging, or both forming and enlarging a wellbore. Non-limiting examples of bits include fixed-cutter (drag) bits, fixed-cutter coring bits, fixed-cutter eccentric bits, fixed-cutter bicenter bits, fixed-cutter reamers, expandable reamers with blades bearing fixed cutters, and hybrid bits including both fixed cutters and movable cutting structures (e.g., roller cones).

As used herein, the term "fixed cutter" means and includes a cutting element configured for a shearing cutting action, abrasive cutting action or impact (percussion) cutting action and fixed with respect to rotational movement in a structure bearing the cutting element, such as, for example, a bit body or blade, tool body or blade, or reamer blade, without limitation.

As used herein, the terms "wear element" and "bearing element" respectively mean and include elements mounted to an earth-boring tool and which are not configured to substantially cut or otherwise remove formation material when contacting a subterranean formation in which a wellbore is being drilled or enlarged.

As used herein, the term "drilling element" means and includes fixed cutters, wear elements, and bearing elements. For example, drilling elements may include cutting elements, pads, elements making rolling contact, elements that reduce friction with formations, PDC bit blades, cones, elements for altering junk slot geometry, etc.

As used herein, any relational term, such as "first," "second," etc., is used for clarity and convenience in understanding the disclosure and accompanying drawings, and does not connote or depend on any specific preference or order, except where the context clearly indicates otherwise.

As used herein, the term "substantially" in reference to a given parameter, property, or condition means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Some embodiments of the present disclosure include drilling systems and drill bits that include gage pads having different lengths. Relatively shorter gage pads may be present in blades configured for use with retractable elements and actuation devices operably coupled to the retractable elements. For example, the relatively shorter gage pads may include a filled or unfilled recess extending into the corresponding blades from an upper side of the gage pads, in which the actuation devices may be positioned. The relatively shorter length of the gage pads may exist to facilitate manufacturing of the recess, such as to accommodate a milling tool used to form the recess. Relatively longer gage pads may be present in blades lacking retractable elements and actuation devices. The relatively longer gage pads may provide improved stability to the drilling systems and drill bits, compared to drilling systems and drill bits that include gage pads having uniform lengths.

FIG. 1 is a schematic diagram of an example of a drilling system 100 that may utilize the apparatuses and methods disclosed herein for drilling wellbores. FIG. 1 shows a wellbore 102 that includes an upper section 104 with a casing 106 installed therein and a lower section 108 that is being drilled with a drill string 110. The drill string 110 may include a tubular member 112 that carries a drilling assembly 114 at its lower end. The tubular member 112 may be made up by joining drill pipe sections or it may be a string of coiled tubing. A drill bit 116 may be attached to the lower end of the drilling assembly 114 for drilling the wellbore 102 of a selected diameter in a formation 118. As used herein, the term "upper" in reference to a downhole tool, system, or feature, means a side that is closer to a surface 122 of the formation 118 within the wellbore 102 when in use, without regard whether the tool, system, or feature is oriented vertically, horizontally, or otherwise. Similarly, as used herein, the term "lower" means a side that is more distant from the surface 122 of the formation 118 within the wellbore 102 when in use.

The drill string 110 may extend to a rig 120 at the surface 122 of the formation 118. The rig 120 shown is a land rig 120 for ease of explanation. However, the apparatuses and methods disclosed herein equally apply when an offshore rig 120 is used for drilling wellbores in an underwater formation. A rotary table 124 (also referred to as a "top drive" in the industry) may be coupled to the drill string 110 and may be utilized to rotate the drill string 110 and to rotate the drilling assembly 114, and thus the drill bit 116, to form the wellbore 102. Alternatively or additionally, a drilling motor 126 (also referred to as a "mud motor") may be provided in the drilling assembly 114 to rotate the drill bit 116. The drilling motor 126 may be used alone to rotate the drill bit 116 or to superimpose the rotation of the drill bit 116 by the drill string 110. The rig 120 may also include conventional equipment, such as a mechanism to add additional sections to the tubular member 112 as the wellbore 102 is drilled. A surface control unit 128, which may be a computer-based unit, may be placed at the surface 122 for receiving and processing downhole data transmitted by sensors 140 in the drill bit 116 and sensors 140 in the drilling assembly 114, and for controlling selected operations of various devices and sensors 140 in the drilling assembly 114. The sensors 140 may determine, for example, acceleration, weight on bit, torque, pressure, cutting element positions, rate of penetration, inclination, azimuth formation/lithology, etc. In some embodiments, the surface control unit 128 may include a processor 130 and a data storage device 132 (e.g., a computer-readable medium) for storing data, algorithms, and computer programs 134. The data storage device 132 may be any suitable device, including, but not limited to, a read-only memory (ROM), a random-access memory (RAM), a Flash memory, a magnetic tape, a hard disk, and an optical disc. During drilling, a drilling fluid from a source 136 thereof may be pumped under pressure through the tubular member 112, which discharges at the bottom of the drill bit 116 and returns to the surface 122 via an annular space (also referred to as the "annulus") between the drill string 110 and an inside wall 138 of the wellbore 102.

The sensors 140 may also include sensors 140 generally known as measurement-while-drilling (MWD) sensors 140 or logging-while-drilling (LWD) sensors 140, and sensors 140 that provide information relating to the behavior of the drilling assembly 114, such as drill bit rotation (revolutions per minute or "RPM"), tool face pressure, vibration, whirl, bending, and stick-slip conditions. The drilling assembly 114 may further include a controller unit 142 that controls the operation of one or more devices and sensors 140 in the drilling assembly 114. For example, the controller unit 142 may be disposed within the drill bit 116 (e.g., within a shank and/or crown of a bit body of the drill bit 116). The controller unit 142 may include, among other things, circuits to process the signals from sensor 140, a processor 144 (such as a microprocessor) to process the digitized signals, a data storage device 146 (such as a solid-state-memory), and a computer program 148. The processor 144 may process the digitized signals, control downhole devices and sensors 140, and communicate data information with the surface control unit 128 via a two-way telemetry unit 150.

The drill bit 116 may include a face section 152. The face section 152 or a portion thereof may face the undrilled formation 118 in front of the drill bit 116 at the wellbore 102 bottom during drilling. In some embodiments, the drill bit 116 may include one or more retractable elements 154 that may be extended and retracted from a surface of the drill bit 116, such as from a blade projecting from the face section 152. An actuation device 156 may control the rate of extension and retraction of the retractable element 154 with respect to the drill bit 116. In some embodiments, the actuation device 156 may be a passive device that automatically adjusts or self-adjusts the rate of extension and retraction of the retractable element 154 based on or in response to a force or pressure applied to the retractable element 154 during drilling. In some embodiments, the actuation device 156 and retractable element 154 may be actuated by contact of the retractable element 154 with the formation 118. In some drilling operations, substantial forces may be experienced on the retractable elements 154 when a depth of cut ("DOC") of the drill bit 116 is changed rapidly. Accordingly, the actuation device 156 may be configured to resist sudden changes to the DOC of the drill bit 116. In some embodiments, the rate of extension and retraction of the retractable element 154 may be preset. The actuation device 156 may include, for example, a dampener and/or a spring operably coupled to the retractable element 154. Suitable retractable elements 154 and actuation devices 156 are described, for example, in U.S. patent application Ser. No. 14/972,635, filed on Dec. 17, 2015, published as U.S. Patent Pub. No. 2017/017454, the entire disclosure of which is incorporated herein by reference. The blades of the drill bit 116 may include gage pads 158 including radially outer surfaces at or proximate a largest outer diameter of the drill bit 116. The gage pads 158 on blades including an actuation device 156 and retractable element 154 may be relatively shorter than the gage pads 158 on blades lacking an actuation device 156 and retractable element 154. Drill bits including suitable retractable elements 154 and actuation devices 156 are also commercially available, such as the TERRADAPT® drill bit available from Baker Hughes, a GE company, of Houston, Tex.

Figure 2:
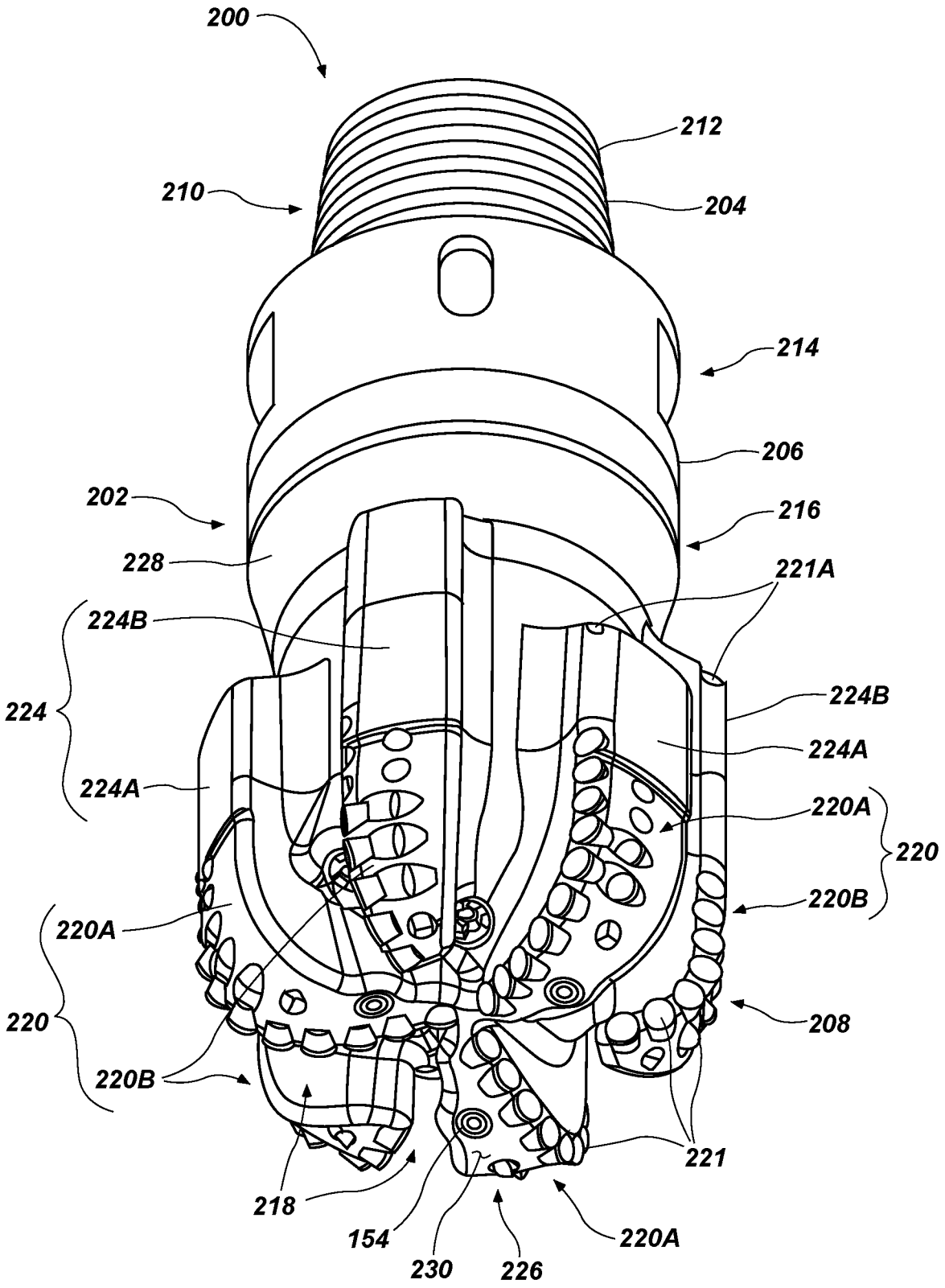
FIG. 2 is a perspective view of a drill bit having a variable gage length according to an embodiment of the present disclosure.
Figure 3:
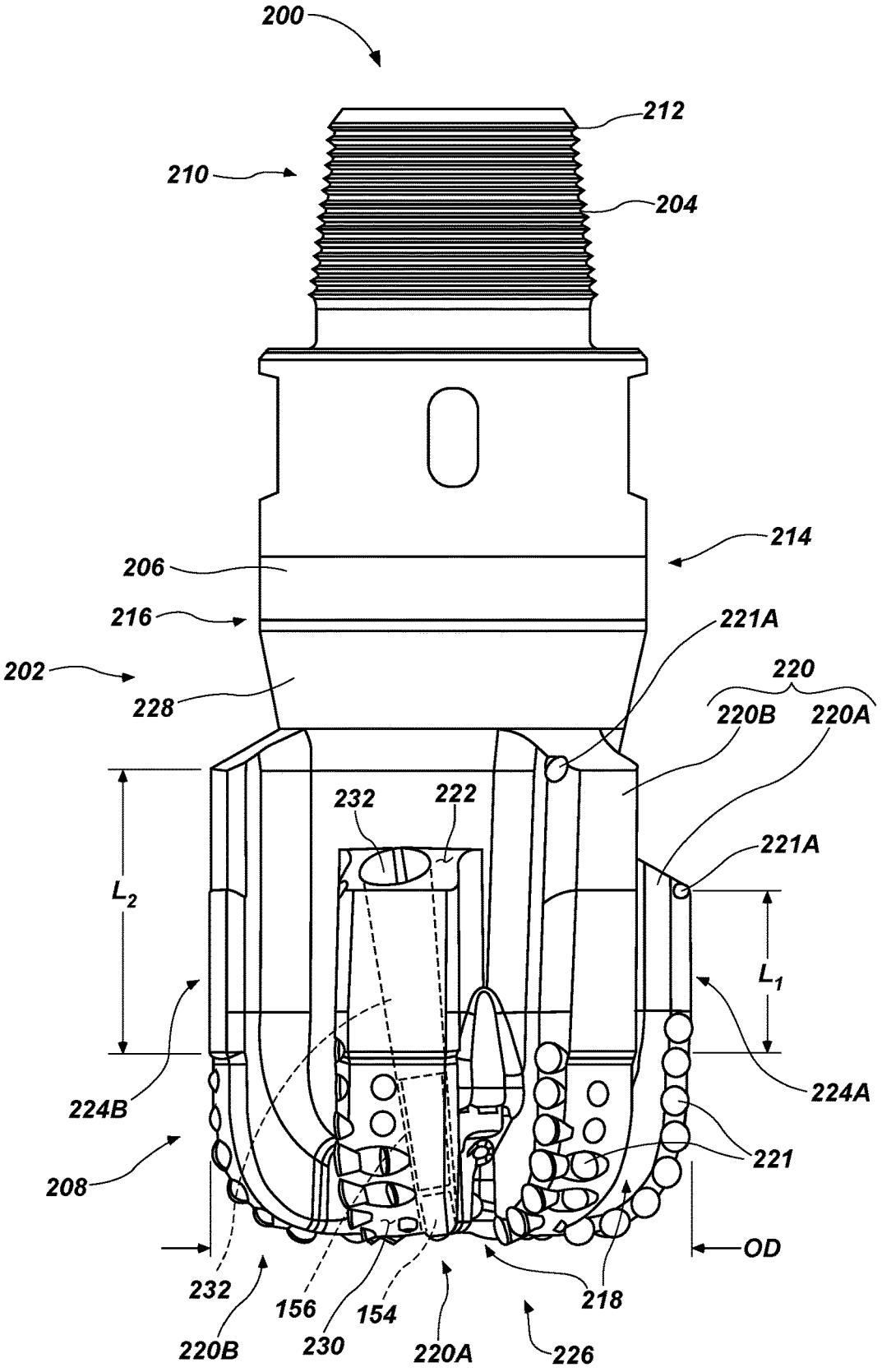
FIG. 3 is a side view of the drill bit of FIG. 2.

FIGS. 2 and 3 show an earth-boring tool 200 including retractable elements 154 according to an embodiment of the present disclosure. In some embodiments, the earth-boring tool 200 includes a fixed-cutter polycrystalline diamond compact (PDC) bit having a bit body 202 that includes a neck 204, a shank 206, and a crown 208. The earth-boring tool 200 may be any suitable drill bit, such as a fixed-cutter or hybrid drill bit, or other earth-boring tool for use in forming a wellbore in a formation. The crown 208 may be substantially formed of a steel material or of a particle-matrix composite material, for example.

The neck 204 of the bit body 202 may have a tapered upper end 210 having threads 212 thereon for connecting the earth-boring tool 200 to the drilling assembly 114 (FIG. 1). The shank 206 may include a lower straight section 214 that is fixedly connected to the crown 208 at a joint 216. The crown 208 may include a number of blades 220 separated from each other by junk slots 218. Each blade 220 may have multiple regions (e.g., cone, nose, shoulder, gage) as is known in the art, and may support drilling elements 221 thereon. In some embodiments, one or more upper drilling elements 221A may be positioned on each blade 220 at an upper end thereof, such as to facilitate removal or other upward movement of the earth-boring tool 200 within a wellbore.

The earth-boring tool 200 may include one or more retractable elements 154 protruding from, and configured to extend and retract from, a lower surface 230 of the earth-boring tool 200. For example, the bit body 202 of the earth-boring tool 200 may carry (e.g., have attached thereto) a plurality of retractable elements 154. As shown in FIG. 3 in dashed lines, the retractable element 154 and a corresponding actuation device 156 may be disposed in a recess 232 in the crown 208. The actuation device 156 may be operably coupled to the retractable element 154, and may be configured to control rates at which the retractable element 154 extends and retracts from the earth-boring tool 200 relative to the lower surface 230 of the earth-boring tool 200. The actuation device 156 may be disposed inside one of the blades 220 extending outward from the bit body 202. In some embodiments, the actuation device 156 may be secured to the bit body 202 within the recess 232 with a press fit. In some embodiments, the recess 232 for housing the actuation device 156 and retractable element 154 may extend through the blade 220 from an upper surface 222 of the blade 220, through a gage region 224 (also referred to as a "gage pad") of the blade 220, and to a face 226 of the bit body 202. For example, the actuation device 156 may be disposed within the gage region 224 of the blade 220, similar to the actuation devices described in U.S. patent application Ser. No. 14/516,069, to Jain, the disclosure of which is incorporated in its entirety herein by this reference. An outer surface of the gage region 224 may be at least partially covered with an abrasion-resistant material, such as a hard-facing material.

Although the recess 232 is shown in FIG. 3 as generally straight cylindrical or tapered cylindrical, the present disclosure is not so limited. For example, the recess 232 may be stepped, with one or more internal shoulders, such as for seating the actuation device 156, the retractable element 154, or a portion thereof. In addition, an upper portion of the recess 232 above the actuation device 156 may be unfilled as shown in FIG. 3 or, in other embodiments, may be filled with a plug or material and/or covered with a cap.

The earth-boring tool 200 may include at least one first blade 220A that includes a recess 232 for the actuation device 156 and retractable element 154, and at least one second blade 220B lacking a similar recess 232, actuation device 156, and retractable element 154. For example, as shown in FIGS. 2 and 3, the earth-boring tool 200 may include three first blades 220A including three respective recesses 232, actuation devices 156, and retractable elements 154, and three second blades 220B lacking these elements. As shown in FIG. 3, the at least one first blade 220A may include a first gage region 224A that has a first longitudinal length $L_1$ (i.e., a length measured along a central axis of the earth-boring tool 200). The at least one second blade 220B may include a second gage region 224B that has a second longitudinal length $L_2$ that is greater than the first longitudinal length $L_1$. Lower ends of the first and second gage regions 224A, 224B may be at substantially the same location along the central axis of the earth-boring tool 200. Upper ends of the first and second gage regions 224A, 224B may be at different locations along the central axis of the earth-boring tool 200. Accordingly, the first longitudinal length $L_1$ of the first gage regions 224A may be relatively shorter than the second longitudinal length $L_2$ of the second gage regions 224B.

For example, the second longitudinal length $L_2$ may be proportionally greater than the first longitudinal length $L_1$. For example, the second longitudinal length $L_2$ may be at least about 125%, at least about 150%, at least about 200%, or at least about 250% of the first longitudinal length $L_1$. In some embodiments, the second longitudinal length $L_2$ may be at least about 1 in., at least about 2 in., at least about 3 in., or at least about 4 in. greater than the first longitudinal length $L_1$. By way of example and not limitation, for an earth-boring tool 200 with a largest outer diameter OD of between about 8.75 in. and about 10.625 in., the first longitudinal length $L_1$ may be between about 2.0 in. and about 4.5 in., such as between about 2.5 in. and about 4.0 in., and the second longitudinal length $L_2$ may be greater than the first longitudinal length $L_1$ and, for example, between about 4.0 in. and about 6.0 in. By way of further non-limiting example, the present disclosure may be applicable to the earth-boring tool 200 at any largest outer diameter OD, such as between about 5.0 in. and about 11.0 in.

Figure 4:
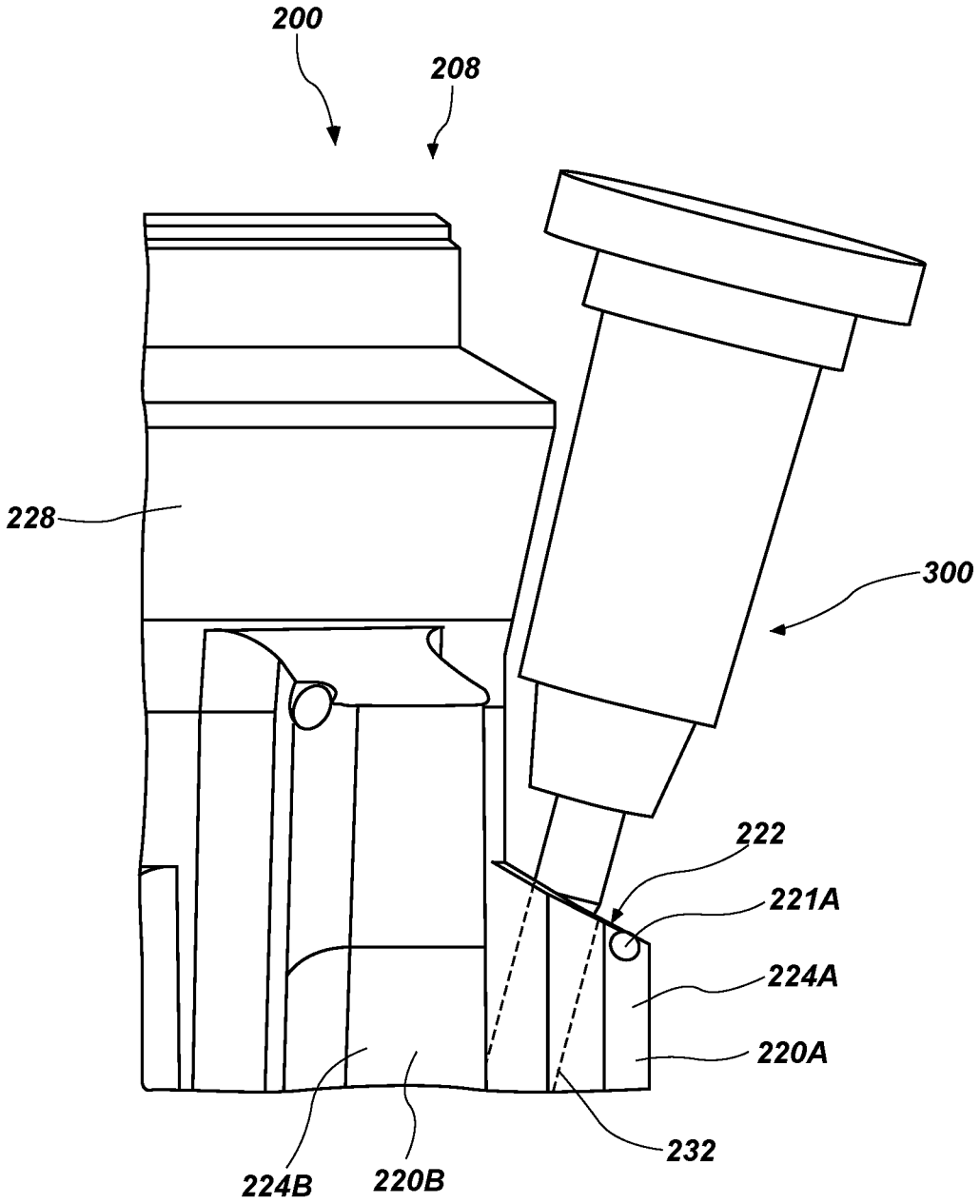
FIG. 4 is a partial side view of the drill bit of FIG. 2 while being manufactured.

FIG. 4 illustrates a detailed view of a portion of the earth-boring tool 200, during a manufacturing process in which a recess 232 is being formed in the crown 208 of the earth-boring tool 200 by a mill 300. As can be seen in FIG. 4, the mill 300 may be used to form the recesses 232 by removing material from the first blades 220A through the upper surfaces 222 thereof. An upper external surface 228 of the crown 208, between the blades 220 and the joint 216 between the crown 208 and the shank 206, may be tapered (e.g., frustoconical), providing clearance for the mill 300. The upper external surface 228 of the crown 208 may taper radially outward in a longitudinally upward direction, relative to the central axis of the earth-boring tool 200. The upper external surface 228 may taper radially outward to a maximum diameter that is substantially equal to an outer diameter of the shank 206. Thus, the crown 208 and the shank 206 may have substantially equal diameters at the joint 216 therebetween. In some embodiments, a weld may be formed at the joint 216.

The first longitudinal length $L_1$ (FIG. 3) of the first gage regions 224A of the first blades 220A may be sized, for example, to provide lateral clearance for the mill 300 and to facilitate reliable formation of the recesses 232 of sufficient length. In some embodiments, the recesses 232 may also be at least partially formed by removing material through the face 226 (FIGS. 2 and 3) of the earth-boring tool 200, in addition to through the upper surfaces 222 of the first blades 220A. After the recesses 232 are at least partially formed, the shank 206 and neck 204 (FIGS. 2 and 3) may be coupled to the crown 208, such as via threads, a press fit, and/or welding.

However, since the recesses 232 may be absent from the second blades 220B, the second longitudinal length $L_2$ (FIG. 3) of the second gage regions 224B of the second blades 220B may be sized to improve stability of the earth-boring tool 200 during use, compared to configurations in which the second gage regions 224B and first gage regions 224A have a same length. In some embodiments, the relatively longer second gage regions 224B may be particularly useful for stabilizing the earth-boring tool 200 while forming lateral (e.g., horizontal or angled) wellbores.

Accordingly, the present disclosure may, in some embodiments, advantageously provide an earth-boring tool 200 with first blades 220A having first gage regions 224A of a first, shorter longitudinal length $L_1$ that provide clearance for forming recesses 232 through the first blades 220A, while also including second blades 220B having second gage regions 224B of a second, greater longitudinal length $L_2$ that improves and/or maintains stability of the earth-boring tool 200 during use.

Additional non-limiting example embodiments of the present disclosure are set forth below.

Embodiment 1

An earth-boring tool, comprising: a body; at least one first blade extending outward from the body, the at least one first blade comprising: an upper surface; a first gage region having a first longitudinal length; and a recess extending at least partially into the at least one first blade from the upper surface; and at least one second blade extending outward from the body, the at least one second blade comprising: a second gage region having a second longitudinal length that is greater than the first longitudinal length.

Embodiment 2

The earth-boring tool of Embodiment 1, wherein the at least one first blade comprises three first blades and the at least one second blade comprises three second blades.

Embodiment 3

The earth-boring tool of Embodiment 1 or Embodiment 2, wherein the recess extends through the at least one first blade from the upper surface to a lower face of the earth-boring tool.

Embodiment 4

The earth-boring tool of Embodiment 3, further comprising an actuation device positioned within the recess and a retractable element operably coupled to the actuation device and protruding from the lower face of the earth-boring tool.

Embodiment 5

The earth-boring tool of any one of Embodiments 1 through 4, wherein the first longitudinal length is between about 2.5 in. and about 4.0 in. and the second longitudinal length is between about 4.0 in. and about 6.0 in.

Embodiment 6

The earth-boring tool of any one of Embodiments 1 through 5, wherein the second longitudinal length is at least about 125% of the first longitudinal length.

Embodiment 7

The earth-boring tool of any one of Embodiments 1 through 6, wherein an outer diameter of the earth-boring tool is between about 5.0 in. and about 11.0 in.

Embodiment 8

The earth-boring tool of any one of Embodiments 1 through 7, wherein the at least one second blade lacks any recess extending into the at least one second blade from an upper surface of the at least one second blade.

Embodiment 9

The earth-boring tool of any one of Embodiments 1 through 8, further comprising drilling elements positioned on the at least one first blade and on the at least one second blade.

Embodiment 10

The earth-boring tool of Embodiment 9, wherein at least one of the drilling elements is an upper drilling element positioned on each of the at least one first blade and the at least one second blade at an upper end thereof.

Embodiment 11

The earth-boring tool of any one of Embodiments 1 through 10, wherein lower ends of the first gage regions and second gage regions are at substantially a same location along a central axis of the earth-boring tool.

Embodiment 12

An earth-boring tool, comprising: a body comprising a shank, neck, and crown coupled to each other, wherein the crown comprises: first blades having first gage regions of a first longitudinal length; second blades having second gage regions of a second longitudinal length greater than the first longitudinal length, the second blades extending closer to the neck than the first blades; and an upper external surface between the neck and the first and second blades, the upper external surface being tapered radially outward in a longitudinally upward direction relative to a central axis of the earth-boring tool.

Embodiment 13

The earth-boring tool of Embodiment 12, further comprising a recess extending longitudinally into each of the first blades from respective upper surfaces of the first blades.

Embodiment 14

The earth-boring tool of Embodiment 13, wherein the recess extends longitudinally through each of the first blades to a lower face of the body.

Embodiment 15

The earth-boring tool of Embodiment 14, further comprising a retractable element disposed partially within and protruding from each of the recesses at the lower face.

Embodiment 16

The earth-boring tool of any one of Embodiments 12 through 15, wherein the upper external surface tapers radially outward to a maximum diameter substantially equal to an outer diameter of the neck.

Embodiment 17

The earth-boring tool of any one of Embodiments 12 through 16, further comprising drilling elements positioned on the first blades and on the second blades.

Embodiment 18

A method of forming an earth-boring tool, the method comprising: forming a body comprising first blades extending outward from the body and having first gage pads of a first longitudinal length and second blades extending outward from the body and having second gage pads of a second, greater longitudinal length; and removing material from the first blades through an upper surface of the first blades to form recesses extending at least partially through the first blades.

Embodiment 19

The method of Embodiment 18, wherein removing material from the first blades comprises milling the first blades.

Embodiment 20

The method of Embodiment 18 or 19, further comprising positioning respective actuation devices and retractable elements coupled to the actuation devices within the recesses.

The embodiments of the disclosure described above and illustrated in the accompanying drawings do not limit the scope of the disclosure, which is encompassed by the scope of the appended claims and their legal equivalents. Any equivalent embodiments are within the scope of this disclosure. Indeed, various modifications of the disclosure, in addition to those shown and described herein, such as alternative useful combinations of the elements described, will become apparent to those skilled in the art from the description. Such modifications and embodiments also fall within the scope of the appended claims and equivalents.

What is claimed is:

1. An earth-boring tool, comprising:

a body comprising a shank and a crown adjacent the shank;

at least one first blade extending outward from the body, the at least one first blade comprising:

an upper surface;

a first gage region having a first longitudinal length; and a recess extending at least partially into the at least one first blade from the upper surface;

at least one second blade extending outward from the body, the at least one second blade comprising:

a second gage region having a second longitudinal length that is greater than the first longitudinal length; and an upper external surface of the crown between the shank and each of the at least one first blade and the at least one second blade, the upper external surface being tapered radially outward in a longitudinally upward direction relative to a central axis of the earth-boring tool, wherein the upper external surface tapers radially outward to a maximum diameter substantially equal to an outer diameter of the shank.

2. The earth-boring tool of claim 1, wherein the at least one first blade comprises three first blades and the at least one second blade comprises three second blades.

3. The earth-boring tool of claim 1, wherein the recess extends through the at least one first blade from the upper surface to a lower face of the earth-boring tool.

4. The earth-boring tool of claim 3, further comprising an actuation device positioned within the recess and a retractable element operably coupled to the actuation device and protruding from the lower face of the earth-boring tool.

5. The earth-boring tool of claim 1, wherein the first longitudinal length is between about 2.5 in. and about 4.0 in. and the second longitudinal length is between about 4.0 in. and about 6.0 in.

6. The earth-boring tool of claim 1, wherein the second longitudinal length is between about 125% and about 250% of the first longitudinal length.

7. The earth-boring tool of claim 1, wherein an outer diameter of the earth-boring tool is between about 5.0 in. and about 11.0 in.

8. The earth-boring tool of claim 1, wherein the at least one second blade lacks any recess extending into the at least one second blade from an upper surface of the at least one second blade.

9. The earth-boring tool of claim 1, further comprising drilling elements positioned on the at least one first blade and on the at least one second blade.

10. The earth-boring tool of claim 9, wherein at least one of the drilling elements is an upper drilling element positioned on each of the at least one first blade and the at least one second blade at an upper end thereof.

11. The earth-boring tool of claim 1, wherein the at least one first blade is flanked on both sides by the at least one second blade and the at least one second blade is flanked on both sides by the at least one first blade.

12. The earth-boring tool of claim 1, wherein lower ends of the first gage region and second gage region are at substantially a same location along the central axis of the earth-boring tool.

13. An earth-boring tool, comprising:

a body comprising a shank, neck, and crown coupled to each other, wherein the crown comprises:

first blades having first gage regions of a first longitudinal length;

second blades having second gage regions of a second longitudinal length greater than the first longitudinal length, the second blades extending closer to the neck than the first blades; and an upper external surface between the shank and the first and second blades, the upper external surface being tapered radially outward in a longitudinally upward direction relative to a central axis of the earth-boring tool, wherein the upper external surface tapers radially outward to a maximum diameter substantially equal to an outer diameter of the shank.

14. The earth-boring tool of claim 13, further comprising a recess extending longitudinally into each of the first blades from respective upper surfaces of the first blades.

15. The earth-boring tool of claim 14, wherein the recess extends longitudinally through each of the first blades to a lower face of the body.

16. The earth-boring tool of claim 15, further comprising a retractable element disposed partially within and protruding from each of the recesses at the lower face.

17. The earth-boring tool of claim 13, further comprising drilling elements positioned on the first blades and on the second blades.

18. A method of forming an earth-boring tool, the method comprising:

forming a body comprising a shank and a crown adjacent the shank, the crown comprising first blades extending outward from the body and having first gage pads of a first longitudinal length and second blades extending outward from the body and having second gage pads of a second, greater longitudinal length, an upper external surface of the crown located between the shank and each of the first blades and the second blades, the upper external surface being tapered radially outward in a longitudinally upward direction relative to a central axis of the earth-boring tool, wherein the upper external surface tapers radially outward to a maximum diameter substantially equal to an outer diameter of the shank; and removing material from the first blades through an upper surface of the first blades to form recesses extending at least partially through the first blades.

19. The method of claim 18, wherein removing material from the first blades comprises milling the first blades.

20. The method of claim 18, further comprising positioning respective actuation devices and retractable elements coupled to the actuation devices within the recesses.

* * * * *